US007415784B2

(12) United States Patent
Song

(10) Patent No.: US 7,415,784 B2
(45) Date of Patent: Aug. 26, 2008

(54) ELECTRIC IRON WITH BOILER-TYPE STEAM GENERATOR

(76) Inventor: Guirong Song, Room 402, No. 221 Furong Yuan, Huli District, Xiamen, Fujian (CN) 361000

( * ) Notice: Subject to any disclaimer, the term of this patent is extended or adjusted under 35 U.S.C. 154(b) by 0 days.

(21) Appl. No.: 11/560,470

(22) Filed: Jan. 19, 2007

(65) Prior Publication Data

US 2007/0169386 A1 Jul. 26, 2007

(30) Foreign Application Priority Data

Jan. 25, 2006 (CN) ..... 2006 2 0080829 U
Feb. 27, 2006 (CN) ..... 2006 2 0006428 U

(51) Int. Cl.
*D06F 75/20* (2006.01)

(52) U.S. Cl. ..... 38/77.83

(58) Field of Classification Search ..... 38/77.8, 38/77.83, 77.6, 77.5, 77.7; 251/314
See application file for complete search history.

(56) References Cited

U.S. PATENT DOCUMENTS 3,130,507 A * 4/1964 Hoecker ..... 38/77.5
3,667,486 A * 6/1972 Cole et al. ..... 134/45
4,875,301 A * 10/1989 Adams ..... 38/14
6,009,645 A * 1/2000 Shimizu et al. ..... 38/77.5
6,678,973 B2 * 1/2004 de Mori ..... 38/77.6

FOREIGN PATENT DOCUMENTS

WO WO 2005/059232 * 6/2005

* cited by examiner

*Primary Examiner*—Ismael Izaguirre
(74) *Attorney, Agent, or Firm*—Matthias Scholl P.C.; Matthias Scholl

(57) ABSTRACT

An electric iron with boiler-type steam generator, comprising: a main body of electric iron; a boiler-type steam generator positioned in the main body of electric iron and a ironing plate positioned at the bottom of the main body of electric iron, a steam chamber is set on the ironing plate, squirt holes which are connected with steam chamber are set in the bottom surface of the ironing plate, a mechanical valve is fixed on the body of the boiler-type steam generator, an intake of said mechanical valve positioned in the said body, the outlet is connected with the steam chamber positioned on the ironing plate by tube, a switch which is connected with the valve core of said mechanical valve and control the valve core is set on the surface of the main body of electric iron.

14 Claims, 9 Drawing Sheets

ELECTRIC IRON WITH BOILER-TYPE STEAM GENERATOR

CROSS-REFERENCE TO RELATED APPLICATIONS

This application claims priority to Chinese Patent Application No. 200620080829.8 filed Jan. 25, 2006 and Chinese Patent Application No. 200620006428.8 filed Feb. 27, 2006, the contents of both of which are incorporated herein by reference.

BACKGROUND OF THE INVENTION

1. Field of the Invention

This invention relates to an electric iron, and more particularly, to an electric iron having a boiler-type steam generator.

2. Brief Description of the Background of the Invention

Electric irons are commonly used in people's daily lives. The easiest method to prevent damage to clothing and to iron clothing wrinkle free is to sprinkle water onto clothing prior to ironing. However, this method is inconvenient as water cannot be sprinkled uniformly onto the clothing by hand. One improvement to this method is the incorporation of water tanks and water spraying systems into electric irons for directly sprinkling water when ironing, which allows for an easy operation and uniform distribution of water onto clothing.

Along with the improvement of people's lives and desire for better quality, the request for better electric irons was advanced, and steam-spraying electric iron was designed. For example, the Chinese Pat. No. 98102941.8 discloses a "spraying steam electric iron", comprising: a water tank which is used for storning water, a steam chamber which is used for vaporizing the water form the water tank into steam, a base which is used for forming the steam chamber, a heating unit which is used for heating the base, a base cover which is used for covering the base, a first tube which is used for guiding water from water tank into the steam chamber, a mixing chamber, water positioned in the water tank is influenced by steam produced from steam chamber and forms corpuscule, the water positioned in the water tank is guided into the second tube of the mixing chamber, the steam positioned in the steam chamber is guided into the steam tube of the mixing chamber, with the influence of steam for sprinkling water from nozzle.

Said water spray sprinkled from said electric iron is a mixture of water and vapor, containing less vapor, and the sprinkling pressure is not enough, said electric iron has a good effect for clothing which is put flat-wise, but not for clothing which is hung. There are other structures of steam electric irons in the market, but most have the same drawbacks.

For obtaining enough steam in the industry, commonly, connecting a boiler-type steam station with electric iron for providing steam which has enough pressure, the principle of producing steam is same as the boiler used in the industry, since the volume is big, inconveniently using, so it is unpopular in the daily life.

Designer integrates boiler-type steam generator with electric iron, requiring the volume must be little enough, so the volume of the switch valve must also be little enough, and meeting the safety criterion. The electromagnetic valve accords with the safety criterion, but its volume can not achieve the minimum limit. So far, we do not find mechanical valve used in the boiler-type steam generator of electric iron.

On the other hand, the boiler-type steam generator and ironing plate adopt a same heating system, their temperature can not be changed separately, for obtaining the steam which has high temperature and high pressure, the boiler-type steam generator need high temperature, however, if the temperature of ironing plate is much higher, the clothing may be damaged, so the boiler-type steam generator and ironing plate can not use the same heating system.

BRIEF SUMMARY OF THE INVENTION

In one embodiment, the invention provides an electric iron with boiler-type steam generator, the mechanical valve is used in the boiler-type steam generator thereof, for producing enough steam which has enough pressure and realizing the object that valve is of enough little volume.

The other object of the present invention is to resolve the problem that boiler-type steam generator and the ironing plate adopt the same heating system.

The technical project of the present invention is: an electric iron with boiler-type steam generator, comprising: a main body of electric iron; a boiler-type steam generator positioned in the main body of electric iron and a ironing plate positioned at the bottom of the main body of electric iron, a steam chamber is set on the ironing plate, squirt holes which are connected with steam chamber are set in the bottom surface of the ironing plate, a mechanical valve is fixed on the body of the boiler-type steam generator, an intake of said mechanical valve positioned in the said body, the outlet is connected with the steam chamber positioned on the ironing plate by tube, a switch which is connected with the valve core of said mechanical valve and control the valve core is set on the surface of the main body of electric iron. Operating by the switch, the high pressure steam produced by the boiler-type steam generator goes through the mechanical valve and the tube into the steam chamber, and sprinkles from the squirt holes which are set in the bottom surface of the ironing plate.

The boiler-type steam generator and the ironing plate have respective heating systems.

Said electric iron with boiler-type steam generator, the mechanical valve of said electric iron, comprising: a valve body and a valve core, the steam intake and the steam outlet which are communicated with each other and a controlling opening are set in the valve body, the valve core goes through the steam intake and the controlling opening, and can moves along the direction of the axis thereof, a valve plug which can hold the steam intake is set on the end of the valve core which is located in the steam intake, the end which is located in the controlling opening is connected with the switch which is positioned on the surface of the main body of electric iron, a spring which makes the valve plug hold the steam intake is set in the valve body. Commonly, the valve plug holds the steam intake by the spring and the mechanical valve is closed, the steam can not go out from the body of the boiler-type steam generator; operating the switch, the valve core moves against the force of the spring, and the valve plug goes away from the steam intake, the mechanical valve is opened, the steam from the body of the boiler-type steam generator goes through the steam intake into the valve body, and goes from steam outlet into steam chamber.

A valve cap is provided on the controlling opening of the valve body of the mechanical valve, the valve core goes through the valve cap, a limiting ring which is against the inner of the valve cap is set in the valve core, a spring is provided between said limiting ring and the bottom of the controlling opening, said steam intake is positioned in the body of the boiler-type steam generator, said valve plug hold the steam intake. Commonly, the valve plug holds the outer end face of the steam intake.

Further, the outer screw thread corresponding to the body of the boiler-type steam generator is formed on the periphery of the steam intake. Said valve body is composed of upper valve body and the lower valve body, said controlling opening is provided in the upper valve body, said steam intake and steam outlet are provided in the lower valve body, an annular sealing unit used for sealing the valve core and valve body is provided between the upper valve body and the lower valve body. The upper valve body and the lower valve body are connected by an annular supporting unit. Said sealing unit can prevent the steam from the body of the boiler-type steam generator from going out of the controlling opening, when the mechanical valve is opened.

Said sealing unit, comprising: two sealing rings which are of silica gel, and annular metallic layer disposed between the said sealing rings, the structure is of good seal.

Said valve plug is set at the end of the valve core by the manner of thread, a silica gel ring is provided between the valve plug and the steam intake, a ring is formed on the periphery of the steam intake, the end face of the ring contacts with said silica gel ring.

Said electric iron with boiler-type steam generator, a watering opening is provide on the body of the boiler-type steam generator, a pressure relief valve is set on said watering opening, the pressure relief valve has a knob which is located outside the main body of electric iron. Said pressure relief valve can relieve pressure when the pressure of the body of the boiler-type steam generator is high.

In addition, the mechanical valve of the electric iron with boiler-type steam generator has the two following structure:

1. Said mechanical valve of said electric iron, comprising: a valve body and a valve core, the steam intake and the steam outlet which are communicated with each other and a controlling opening are set in the valve body, the valve core goes through the steam intake and the controlling opening, and can moves along the direction of the axis thereof, a valve plug which can hold the steam intake is set on the end of the valve core which is located in the steam intake, the end which is located in the controlling opening is connected with the switch which is positioned on the surface of the main body of electric iron, a sealing unit is provided between the controlling opening of the valve body and the valve core, the outer screw thread corresponding to the body of the boiler-type steam generator is formed on the periphery of the steam intake, rotating the valve core by the switch which is positioned on the surface of the main body of electric iron, and the valve core can move relative to the valve body, further, said valve plug holds or goes away of the steam intake, realizing opening and closed of the mechanical valve.

2. Said mechanical valve of said electric iron, comprising: a valve body and a valve core, the steam intake and the steam outlet which are communicated with each other and a controlling opening are set in the valve body, the valve core rotatablely goes through the steam intake and the controlling opening. A steam tube is set on the valve core, one end of said steam tube corresponds to said steam intake, the other end is located on the side wall of the valve core, it can corresponds to the steam outlet of the valve body, during the rotation of the valve core, sealing rings are respectively provided between the controlling opening of the valve body the steam intake and the valve core. The valve core can be rotated by the switch which is positioned on the surface of the main body of electric iron, and the steam intake is communicated with the steam outlet, the mechanical valve is opened.

It is known from the description of the structure of the present utility, compared with the existing technology, the advantage of the present invention are as following: 1. Providing enough steam which is of high pressure, controlling the steam by mechanical valve, and the volume is minimum, so the volume of said electric iron can not be bigger than the ordinary iron's. 2. since the boiler-type steam generator and ironing plate have respective heating systems, the temperature of the two can be controlled respectively, and the steam which is of high temperature and high pressure can be sprinkled from the bottom of the ironing plate, and the temperature of the ironing plate is suited for clothing; 3. after test, the working life of the mechanical valve is more than 50000 times, meeting the safety criterion.

BRIEF DESCRIPTION OF THE DRAWINGS

Many of the attendant advantages of the present invention will become more readily apparent and better understood as the following detailed description is considered in connection with the accompanying drawings in which.

DETAILED DESCRIPTION OF THE INVENTION

The first embodiment of the present invention will be explained with reference to the FIG.1 ~FIG. 5, FIG. 9.

Figure 1:
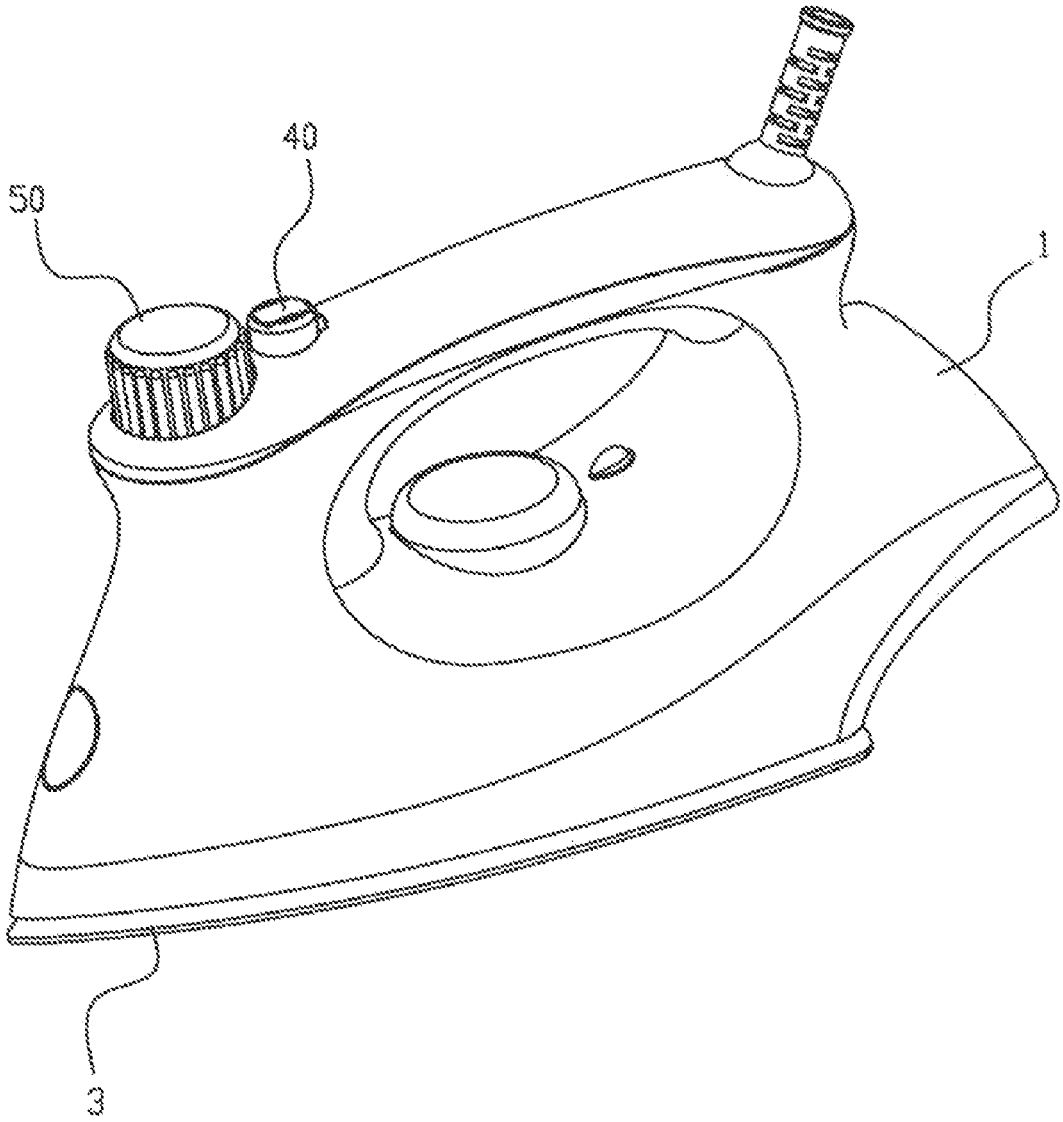
FIG. 1 is the stereogram of the first embodiment of the present invention.
Figure 2:
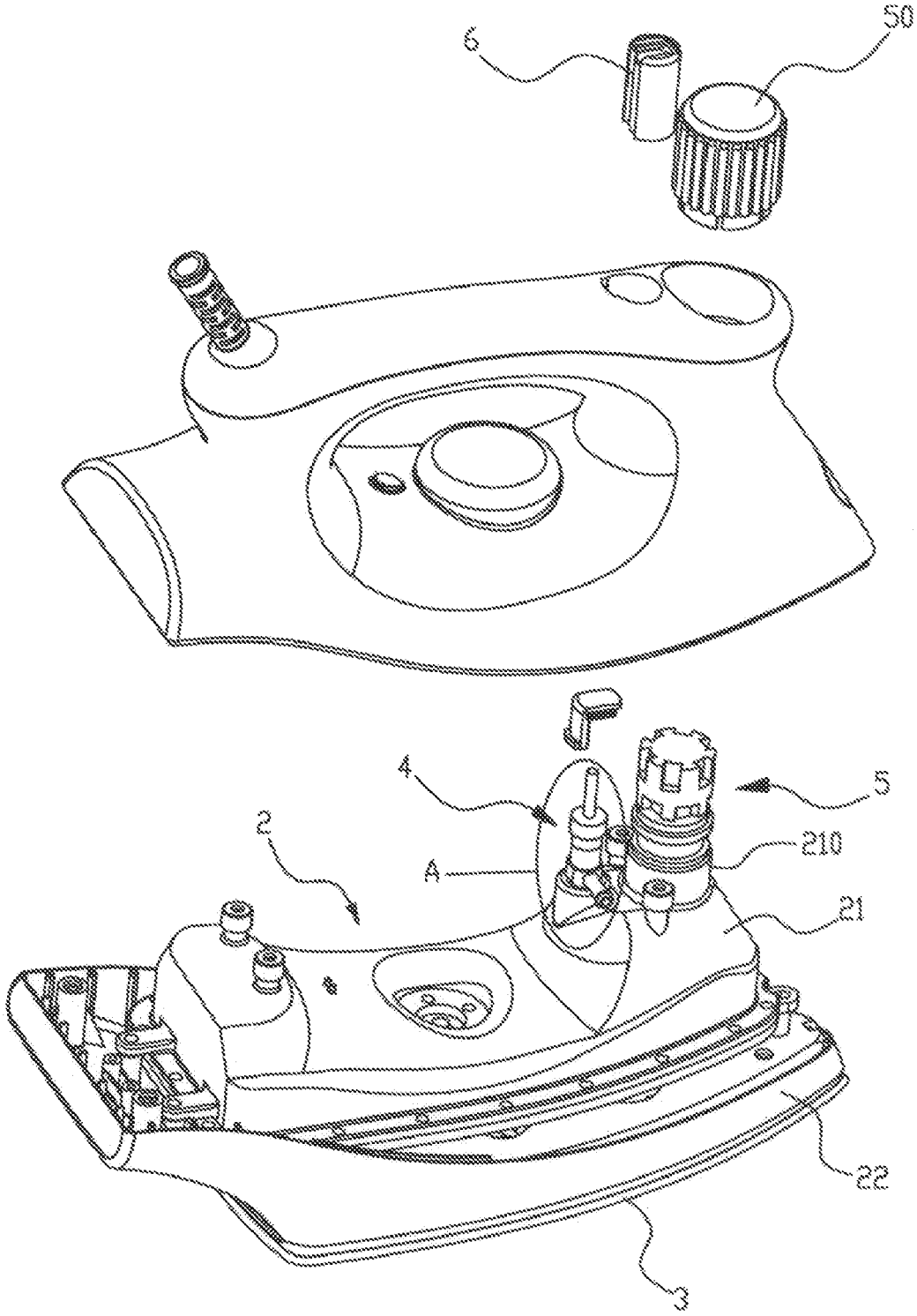
FIG. 2 is the exploded view of the first embodiment of the present invention.

The embodiment is to provide an electric iron with boiler-type steam generator, referring to FIG. 1 and FIG. 2, said electric iron comprising: a main body 1 of electric iron; a boiler-type steam generator 2 positioned in the main body 1 of electric iron and a ironing plate 3 positioned at the bottom of the main body 1 of electric iron, a steam chamber 22 is set on the ironing plate 3, squirt holes which are connected with steam chamber 22 are set in the bottom surface of the ironing plate 3, a mechanical valve 4 is fixed on the body 21 of the boiler-type steam generator 2, said mechanical valve 4 is connected with the steam chamber 22 by a tube, the high pressure steam from the body 21 goes into the steam chamber 22, when the mechanical valve 4 is opened, further, the steam sprinkles from the squirt holes which are set in the bottom surface of the ironing plate 3 a watering opening 210 is provide on the body 21 of the boiler-type steam generator, a pressure relief valve 5 is set on said watering opening 210, the pressure relief valve 5 has a knob 5 which is located out of the main body 15 of electric iron. Said pressure relief valve 5 can relieve pressure when the pressure of the body 21 of the boiler-type steam generator is high. The boiler-type steam generator 2 adopts electrical heating device for heating, it is same as existing technology.

Figure 3:
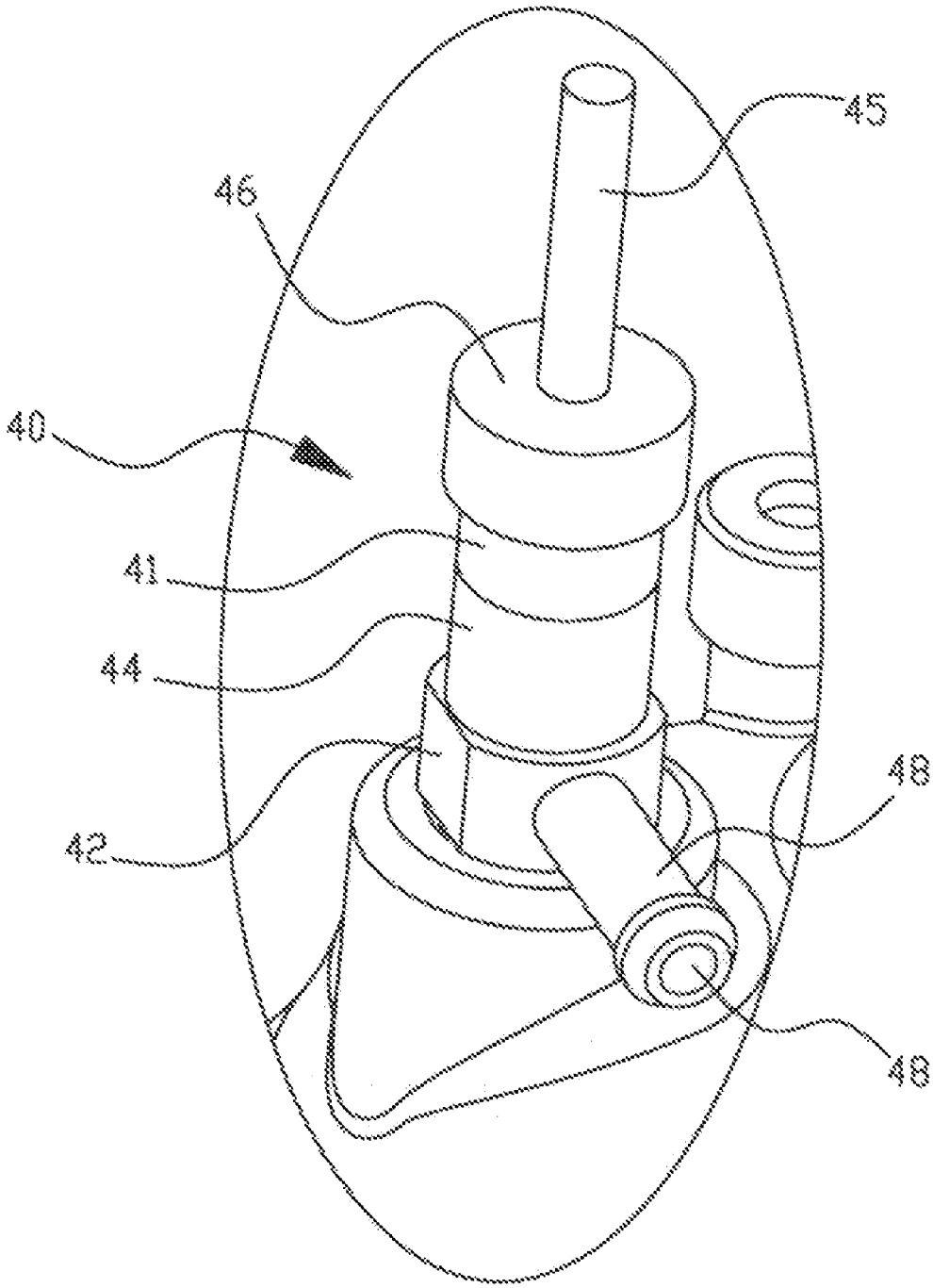
FIG. 3 is the enlarged view of portion A according to FIG. 2.
Figure 4:
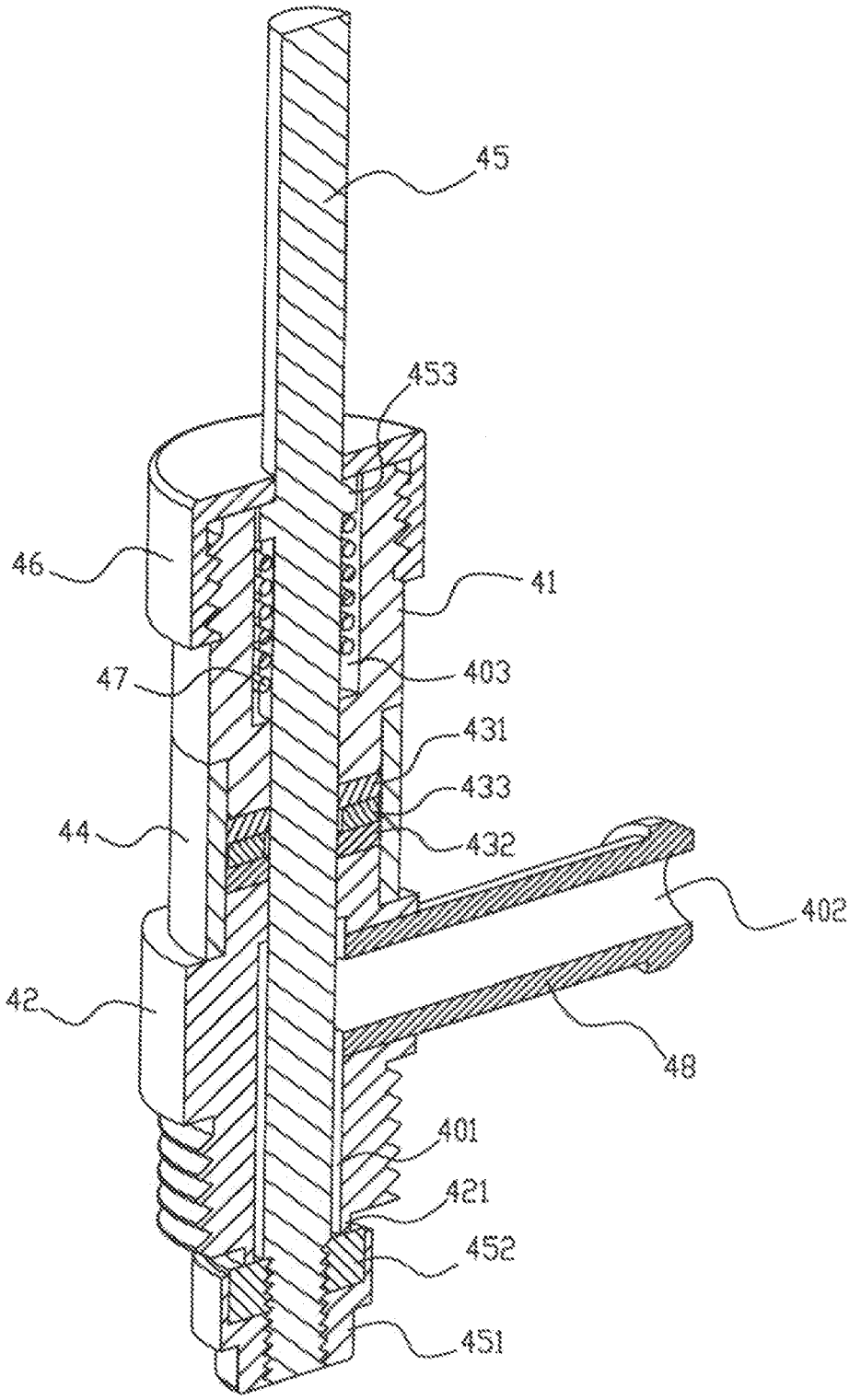
FIG. 4 is the cross-sectional view of the mechanical valve of the first embodiment of the present invention.
Figure 5:
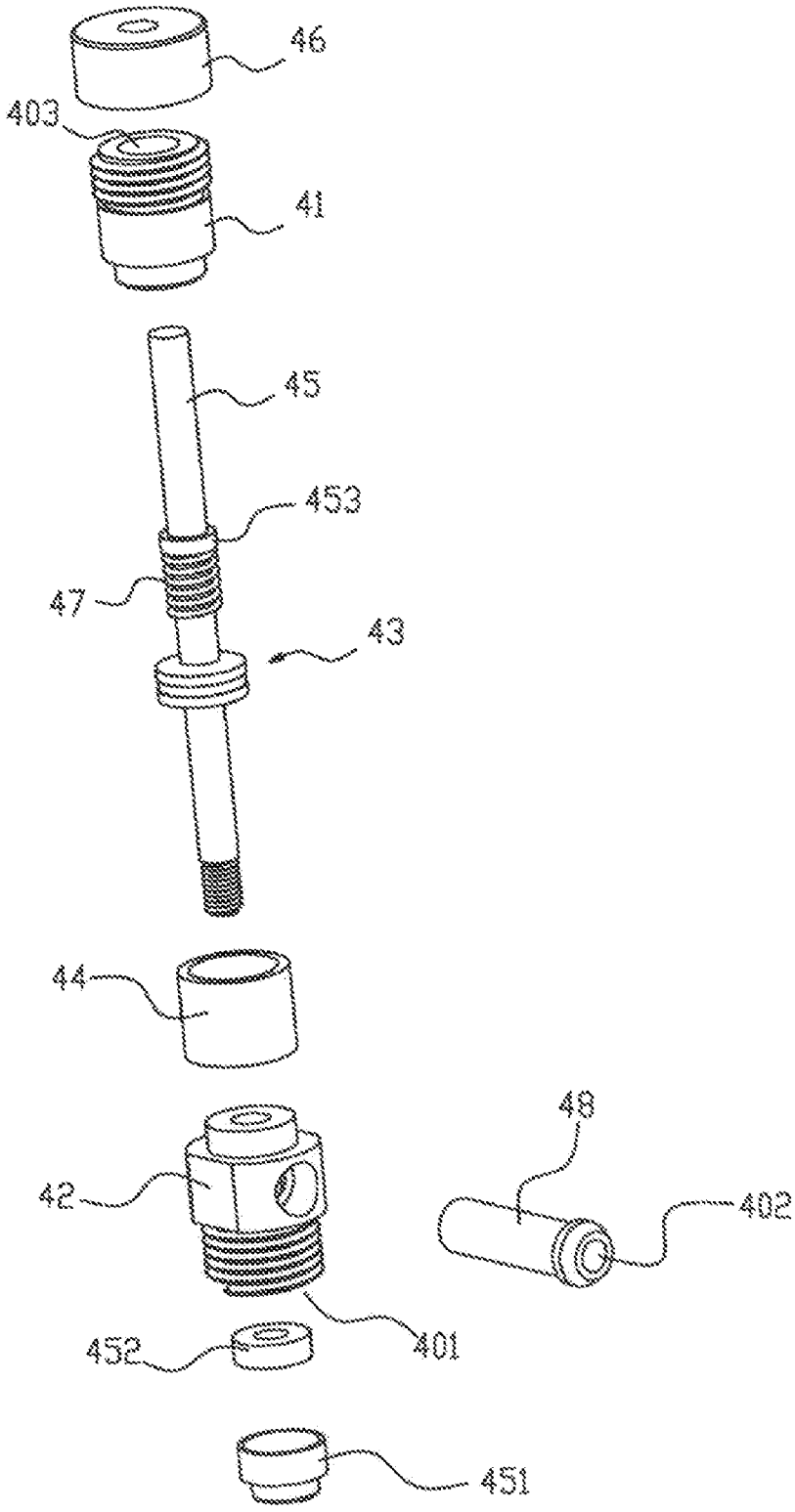
FIG. 5 is the exploded view of the mechanical valve of the first embodiment of the present invention.

Referring to FIG. 3, FIG. 4, FIG. 5, said mechanical valve 4, comprising: a valve body 40 and a valve core 45 the valve body 40 is composed of upper valve body 41 and the lower valve body 42, a controlling opening 403 is provided in the upper valve body 41, a steam intake 401 is provided under the lower valve body 42, the axis of the controlling opening 403 and the steam intake 401 are positioned in the same line direction, a connecting tube 48 is set on the side wall, said connecting tube 48 forms a steam outlet 402, the axis of the steam outlet 402 is perpendicular to the axis of the controlling opening 403 and the steam intake 401, and the steam outlet 402 is communicated with the steam intake 401 the valve core 45 goes through the controlling opening 403 and the steam intake 401, can moves along the direction of the axis thereof, an annular sealing unit 43 used for sealing the valve core 45 and valve body 40 is provided between the upper valve body 41 and the lower valve body 42, the upper valve body 41 and the lower valve body 42 are connected by an annular supporting unit 44. Said sealing unit 43, comprising: two sealing rings 431, 432 which are of silica gel, and annular metallic layer 433 disposed between the said sealing rings, the structure is of good seal. Said sealing unit 43 can prevent the steam from the body 21 of the boiler-type steam generator from going out of the controlling opening 403, when the mechanical valve 4 is opened.

A valve cap 46 is provided on the controlling opening 403 of the valve body of the mechanical valve, the valve core 45 goes through the valve cap 46, connected with the switch 6 which is positioned on the surface of the main body 1 of electric iron, said switch 6 is a button, a limiting ring 453 which is against the inner of the valve cap 46 is set in the valve core 45, a spring 47 is provided between said limiting ring 453 and the bottom of the controlling opening 403, by the force of the spring 47, the valve core 45 moves to the controlling opening 403. A valve plug 451 is set on the end of the valve core 45 which is located in the steam intake 401, said valve plug 451 is set at the end of the valve core by the manner of thread, a silica gel ring 452 is provided between the valve plug 451 and the steam intake 401, a ring 421 is formed on the periphery of the steam intake 401, the end face of the ring 421contacts with said silica gel ring 452. Commonly, by the force of the spring 47, the silica gel ring 452 holds said ring 421, the steam intake 401 is sealed, and the mechanical valve 4 is closed.

An outer screw thread corresponding to the body 21 of the boiler-type steam generator 2 is formed on the periphery of the steam intake 401, when the mechanical valve 4 is fixed in the body 21, the steam intake 401 is located in the body 21, the steam outlet 402 is located outside the body 21, connected with the steam chamber 22 of the ironing plate 3 by the tube, turn on the switch 6 which is positioned on the surface of the main body 1 of electric iron, and the high pressure steam from the boiler-type steam generator 2 can go through the mechanical valve 4 and the tube into the steam chamber 22, sprinkles from the squirt holes which are set in the bottom surface of the ironing plate 3.

Figure 9:
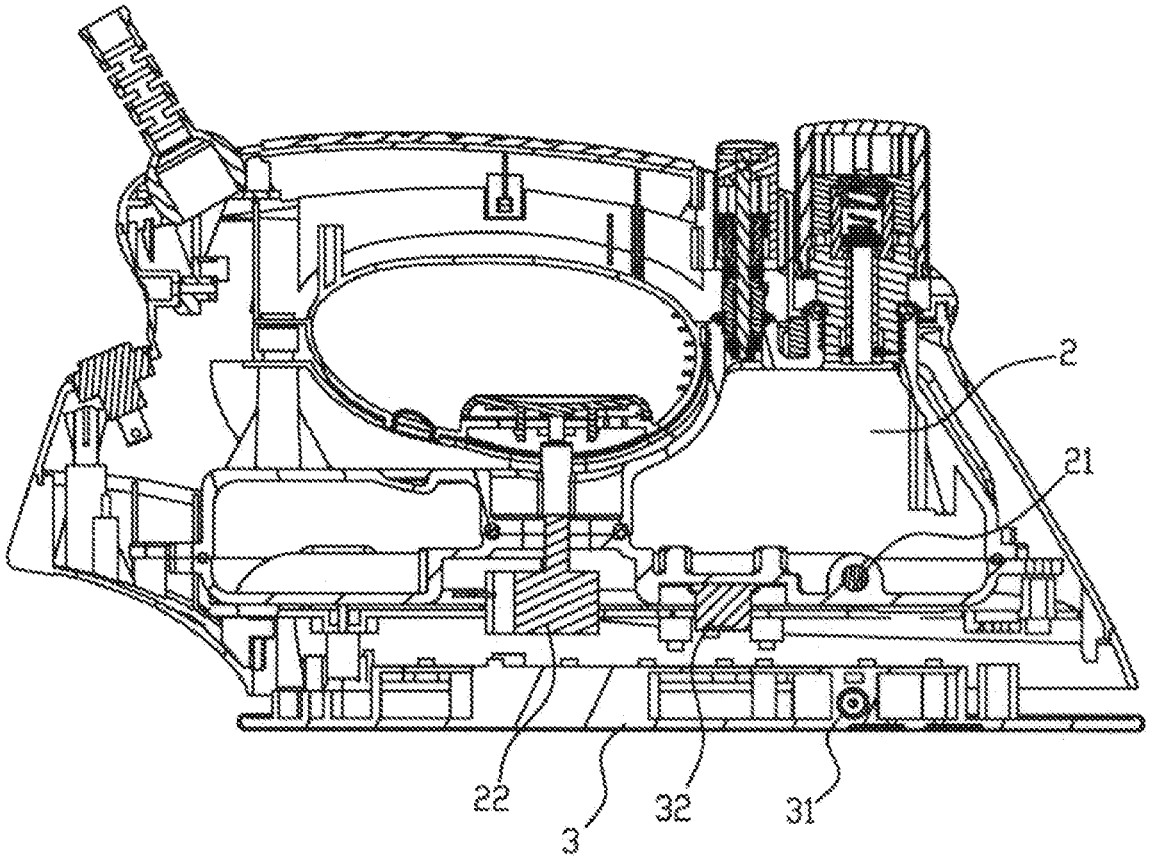
FIG. 9 is the cross-sectional view of the first embodiment of the present invention, illustrating the respective heating systems of the boiler-type steam generator and ironing plate.

Referring to FIG. 9, the boiler-type steam generator 2 and the ironing plate 3 have respective heating systems, the heating system of the boiler-type steam generator 2, comprising: the tubular electric heating element 21 and the temperature control device 22, the heating system of the ironing plate 3, comprising: the tubular electric heating element 31 and the temperature control device 32, the tubular electric heating element and the temperature control device are cover by existing technology, so they are unnecessary to be explained.

Figure 6:
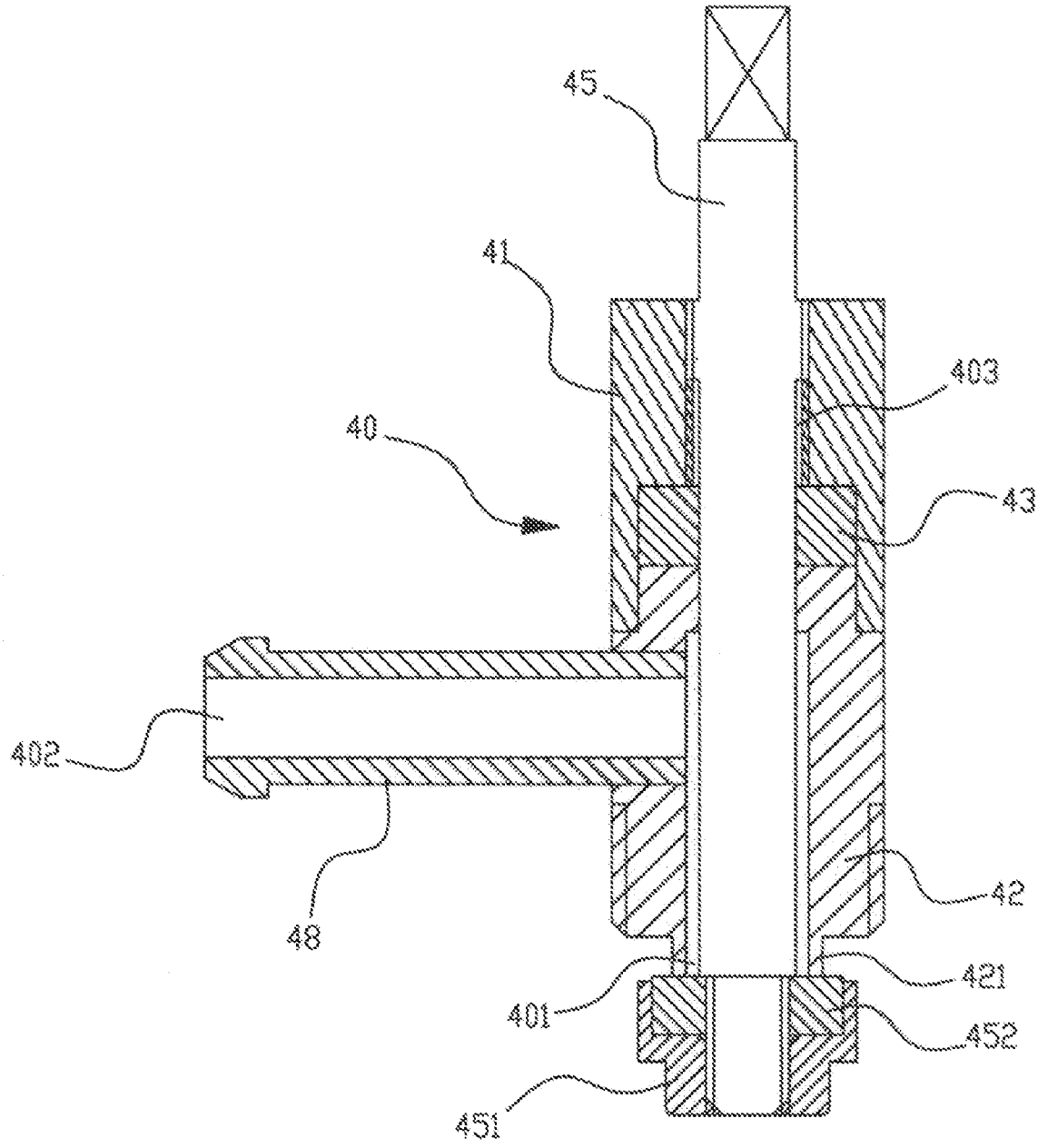
FIG. 6 is the cross-sectional view of the mechanical valve of the second embodiment of the present invention.

The second embodiment of the present invention, the main structure is same as the first embodiment's, the main difference between them is: the structure of the mechanical valve 4. Referring to FIG. 6, the mechanical valve 4, comprising: a valve body 40 and a valve core 45, the steam intake 401 and the steam outlet 402 which are communicated with each other and a controlling opening 403 are set in the valve body 40, the valve core 45 goes through the steam intake 401and the controlling opening 403, and can moves along the direction of the axis thereof, a valve plug 451 which can hold the steam intake 401 is set on the end of the valve core 45 which is located in the steam intake, the end which is located in the controlling opening 403 is connected with the switch 6 which is positioned on the surface of the main body 1 of electric iron, a sealing unit 43 is provided between the controlling opening 403 of the valve body 40 and the valve core 45, the outer screw thread corresponding to the body 21 of the boiler-type steam generator 2 is formed on the periphery of the steam intake 401, rotating the valve core 45 by the switch 6 which is positioned on the surface of the main body 1 of electric iron, and the valve core 45 can move relative to the valve body 40, further, said valve plug 451 holds or goes away of the steam intake 401, realizing opening and closed of the mechanical valve 4.

Said steam outlet 402 is formed on the connecting tube 48 which is perpendicular to the valve body 40. The valve body 40 is composed of the upper valve body 41 and the lower valve body 42, the sealing unit 43 is provided between the upper valve body 41 and the lower valve body 42, the silica gel ring 452 is provided between the valve plug 451 and the steam intake 401, a ring 421 is formed on the periphery of the steam intake 401, when the mechanical valve 4 is closed, the silica gel ring 452 holds the ring 421, and the steam intake 401 is sealed.

Figure 7:
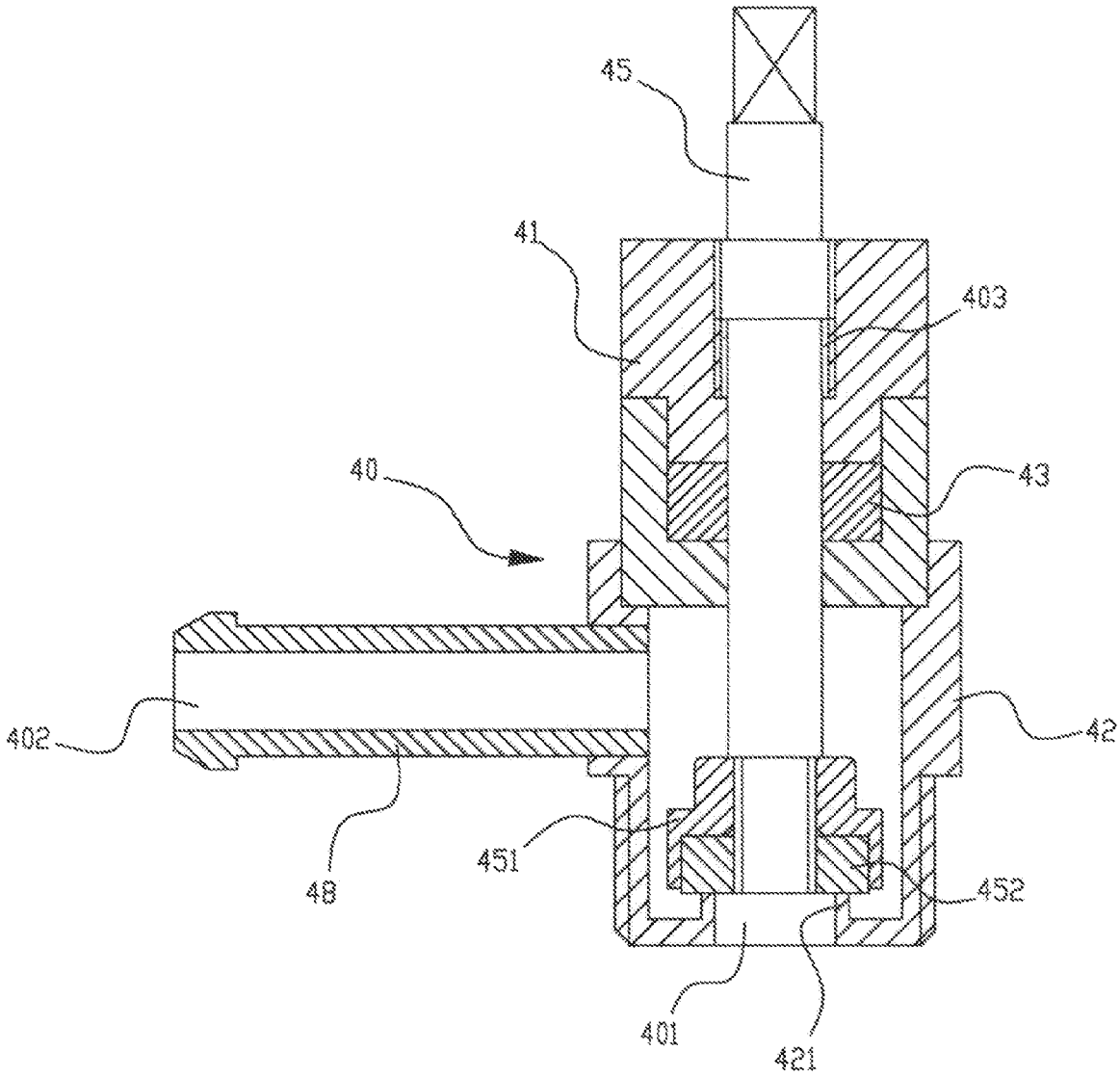
FIG. 7 is the cross-sectional view of the mechanical valve of the third embodiment of the present invention.

The third embodiment of the present invention, the main structure is same as the second embodiment's, the main difference is: the structure of the mechanical valve 4. Referring to FIG. 7, the valve plug 451 is located in the inner of the valve body 40, and the valve plug 451 can hold the steam intake 401 from the inner of the valve body 40 to the outer of the valve body 40, when the valve core 45 moves downwardly, the valve plug 451 holds the steam intake 401, the ring 421 located in the inner of the valve body 40 extends inwardly, the silica gel ring 452 is located on the lower face of the valve plug 451.

Figure 8:
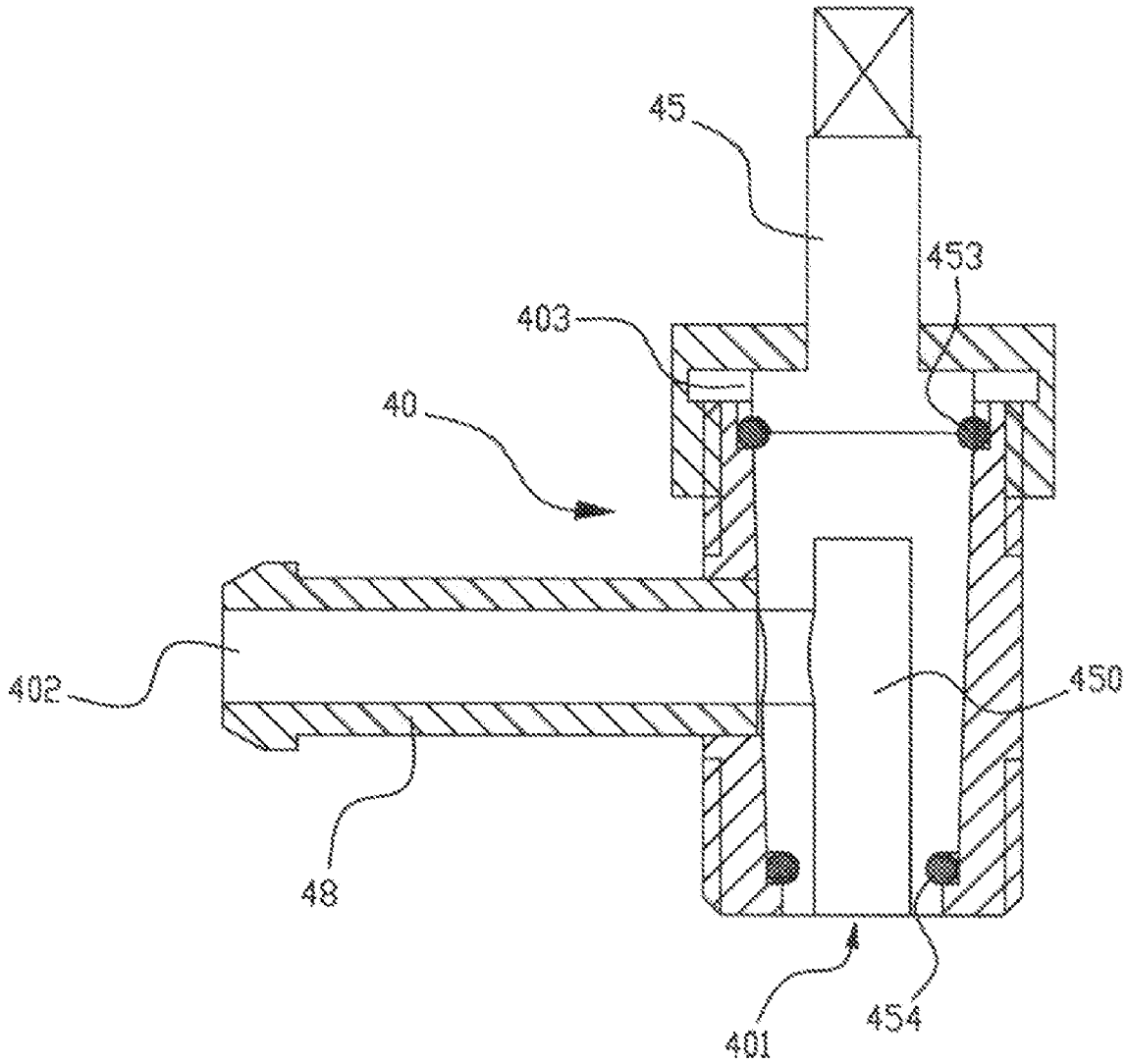
FIG. 8 is the cross-sectional view of the mechanical valve of the fourth embodiment of the present invention.

The fourth embodiment of the present invention, the main structure is same as the third embodiment's, the main difference is: the structure of the mechanical valve 4. Referring to FIG. 8, the mechanical valve 4, comprising: a valve body 40 and a valve core 45, the steam intake 401 and the steam outlet 402 which are communicated with each other and a controlling opening 403 are set in the valve body 40, the steam outlet 402 is formed on the connecting tube 48 which is perpendicular to the valve body 40. The valve core rotatably goes through the steam intake 401 and the controlling opening 402. A steam tube 450 is set on the valve core 45, one end of said steam tube 450 corresponds to said steam intake 401, the other end is located on the side wall of the valve core 45, it can correspond to the steam outlet 402 of the valve body 40, during the rotation of the valve core 45, sealing rings 453, 454 are respectively provided between the controlling opening of the valve body, the steam intake and the valve core. Referring to FIG. 2, the valve core 45 can be rotated by the switch 6 which is positioned on the surface of the main body 1 of electric iron, and the steam intake 401 is communicated with the steam outlet 402 by the steam tube 450, the mechanical valve 4 is opened.

As mentioned above, they are four embodiments of the present invention, they do not limit the scope of the present invention, the present invention is to control the opening and closed of the steam outlet of the body of the boiler-type steam generator by mechanical valve, and the volume of the valve is minimum, and meeting the safety criterion, the equivalent change and the modify based on the contents of the present invention, are belong to the scope of the present invention

What is claimed is:

1. An electric iron with a boiler-type steam generator comprising: a main body of the electric iron; a boiler-type steam generator positioned in the main body of the electric iron and an ironing plate positioned at the bottom of the main body of the electric iron, wherein a steam chamber set is set on the ironing plate, squirt holes which are connected with steam chamber are set in the bottom surface of the ironing plate, a mechanical valve is fixed on the body of the boiler-type steam generator, an intake of said mechanical valve is positioned in said body, the outlet is connected by tube with the steam chamber positioned on the ironing plate, a switch is connected with the valve core of said mechanical valve, a control of the valve core is set on the surface of the main body of the electric iron, and said boiler-type steam generator and the ironing plate have respective heating systems.

2. The electric iron with boiler-type steam generator of claim 1, wherein said mechanical valve of said electric iron comprises: a valve body and a valve core, a steam intake and a steam outlet which are in communication with each other and a controlling opening are set in the valve body, the valve core goes through the steam intake and the controlling opening, and can move along the direction of the axis thereof, a valve plug which can hold the steam intake is set on the end of the valve core which is located in the steam intake, the end which is located in the controlling opening is connected with the switch which is positioned on the surface of the main body of electric iron, a spring which makes the valve plug hold the steam intake is set in the valve body.

3. The electric iron with boiler-type steam generator of claim 1, wherein a watering opening is provided on the body of the boiler-type steam generator, a pressure relief valve is set on said watering opening, the pressure relief valve has a knob which is located outside the main body of the electric iron.

4. The electric iron with boiler-type steam generator of claim 1, wherein said mechanical valve, comprises a valve body and a valve core, the steam intake and the steam outlet which are communicated with each other and a controlling opening are set in the valve body, the valve core goes through the steam intake and the controlling opening, and can moves along the direction of the axis thereof, a valve plug which can hold the steam intake is set on the end of the valve core which is located in the steam intake, the end which is located in the controlling opening is connected with the switch which is positioned on the surface of the main body of electric iron, a sealing unit is provided between the controlling opening of the valve body and the valve core, the outer screw thread corresponding to the body of the boiler-type steam generator is formed on the periphery of the steam intake.

5. The electric iron with boiler-type steam generator of claim 1, wherein said mechanical valve of said electric iron, comprises a valve body and a valve core, the steam intake and the steam outlet which are communicated with each other and a controlling opening are set in the valve body, the valve core rotatably goes through the steam intake and the controlling opening, a steam tube is set on the valve core, one end of said steam tube corresponds to said steam intake, the other end is located on the side wall of the valve core, it can corresponds to the steam outlet of the valve body, during the rotation of the valve core, sealing rings are respectively provided between the controlling opening of the valve body, the steam intake and the valve core.

6. An electric iron with a boiler-type steam generator comprising: a main body of the electric iron; a boiler-type steam generator positioned in the main body of the electric iron and an ironing plate positioned at the bottom of the main body of the electric iron, wherein a steam chamber set is set on the ironing plate, squirt holes which are connected with steam chamber are set in the bottom surface of the ironing plate, a mechanical valve is fixed on the body of the boiler-type steam generator, an intake of said mechanical valve is positioned in said body, the outlet is connected by tube with the steam chamber positioned on the ironing plate, a switch is connected with the valve core of said mechanical valve, a control of the valve core is set on the surface of the main body of the electric iron, and said mechanical valve of said electric iron comprises: a valve body and a valve core, a steam intake and a steam outlet which are in communication with each other and a controlling opening are set in the valve body, the valve core goes through the steam intake and the controlling opening, and can move along the direction of the axis thereof, a valve plug which can hold the steam intake is set on the end of the valve core which is located in the steam intake, the end which is located in the controlling opening is connected with the switch which is positioned on the surface of the main body of electric iron, a spring which makes the valve plug hold the steam intake is set in the valve body.

7. The electric iron with boiler-type steam generator of the claim 6, wherein a valve cap is provided on the controlling opening of the valve body of the mechanical valve, the valve core goes through the valve cap, a limiting ring which is against the inner of the valve cap is set in the valve core, a spring is provided between said limiting ring and the bottom of the controlling opening, said steam intake is positioned in the body of the boiler-type steam generator, said valve plug hold the steam intake.

8. The electric iron with boiler-type steam generator of claim 7, wherein the outer screw thread corresponding to the body of the boiler-type steam generator is formed on the periphery of the steam intake.

9. The electric iron with boiler-type steam generator of claim 6, wherein said valve body is composed of an upper valve body and a lower valve body, said controlling opening is provided in the upper valve body, said steam intake and steam outlet are provided in the lower valve body, an annular sealing unit used for sealing the valve core and valve body is provided between the upper valve body and the lower valve body, the upper valve body and the lower valve body are connected by an annular supporting unit.

10. The electric iron with boiler-type steam generator of claim 9, wherein said sealing unit comprises two sealing rings which are made of silica gel and annular metallic layer disposed between the said sealing rings.

11. The electric iron with boiler-type steam generator of claim 6, wherein said valve plug is set at the end of the valve core by the manner of thread, a silica gel ring is provided between the valve plug and the steam intake, a ring is formed on the periphery of the steam intake, the end face of the ring contacts with said silica gel ring.

12. An electric iron with a boiler-type steam generator comprising: a main body of the electric iron; a boiler-type steam generator positioned in the main body of the electric iron and an ironing plate positioned at the bottom of the main body of the electric iron, wherein a steam chamber set is set on the ironing plate, squirt holes which are connected with steam chamber are set in the bottom surface of the ironing plate, a mechanical valve is fixed on the body of the boiler-type steam generator, an intake of said mechanical valve is positioned in said body, the outlet is connected by tube with the steam chamber positioned on the ironing plate, a switch is connected with the valve core of said mechanical valve, a control of the valve core is set on the surface of the main body of the electric iron, and a watering opening is provided on the body of the boiler-type steam generator, a pressure relief valve is set on said watering opening, the pressure relief valve has a knob which is located outside the main body of the electric iron.

13. An electric iron with a boiler-type steam generator comprising: a main body of the electric iron; a boiler-type steam generator positioned in the main body of the electric iron and an ironing plate positioned at the bottom of the main body of the electric iron, wherein a steam chamber set is set on the ironing plate, squirt holes which are connected with steam chamber are set in the bottom surface of the ironing plate, a mechanical valve is fixed on the body of the boiler-type steam generator, an intake of said mechanical valve is positioned in said body, the outlet is connected by tube with the steam chamber positioned on the ironing plate, a switch is connected with the valve core of said mechanical valve, a control of the valve core is set on the surface of the main body of the electric iron, said mechanical valve, comprises a valve body and a valve core, the steam intake and the steam outlet which are communicated with each other and a controlling opening are set in the valve body, the valve core goes through the steam intake and the controlling opening, and can moves along the direction of the axis thereof, a valve plug which can hold the steam intake is set on the end of the valve core which is located in the steam intake, the end which is located in the controlling opening is connected with the switch which is positioned on the surface of the main body of electric iron, a sealing unit is provided between the controlling opening of the valve body and the valve core, the outer screw thread corresponding to the body of the boiler-type steam generator is formed on the periphery of the steam intake.

14. An electric iron with a boiler-type steam generator comprising: a main body of the electric iron; a boiler-type steam generator positioned in the main body of the electric iron and an ironing plate positioned at the bottom of the main body of the electric iron, wherein a steam chamber set is set on the ironing plate, squirt holes which are connected with steam chamber are set in the bottom surface of the ironing plate, a mechanical valve is fixed on the body of the boiler-type steam generator, an intake of said mechanical valve is positioned in said body, the outlet is connected by tube with the steam chamber positioned on the ironing plate, a switch is connected with the valve core of said mechanical valve, and a control of the valve core is set on the surface of the main body of the electric iron, and said mechanical valve of said electric iron, comprises a valve body and a valve core, the steam intake and the steam outlet which are communicated with each other and a controlling opening are set in the valve body, the valve core rotatably goes through the steam intake and the controlling opening, a steam tube is set on the valve core, one end of said steam tube corresponds to said steam intake, the other end is located on the side wall of the valve core, it can corresponds to the steam outlet of the valve body, during the rotation of the valve core, sealing rings are respectively provided between the controlling opening of the valve body, the steam intake and the valve core.

* * * * *